US010811785B2

(12) United States Patent
Tomura et al.

(10) Patent No.: US 10,811,785 B2
(45) Date of Patent: Oct. 20, 2020

(54) ANTENNA DEVICE

(71) Applicant: Mitsubishi Electric Corporation, Tokyo (JP)

(72) Inventors: Takashi Tomura, Tokyo (JP); Michio Takikawa, Tokyo (JP); Yoshio Inasawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/339,320

(22) PCT Filed: Dec. 8, 2016

(86) PCT No.: PCT/JP2016/086555
§ 371 (c)(1),
(2) Date: Apr. 3, 2019

(87) PCT Pub. No.: WO2018/105081
PCT Pub. Date: Jun. 14, 2018

(65) Prior Publication Data

US 2019/0288405 A1 Sep. 19, 2019

(51) Int. Cl.
*H01Q 21/06* (2006.01)
*H01Q 21/24* (2006.01)
(Continued)

(52) U.S. Cl.
CPC ..... *H01Q 21/24* (2013.01); *H01P 1/161* (2013.01); *H01P 1/2131* (2013.01);
(Continued)

(58) Field of Classification Search
CPC ..... H01Q 21/24; H01Q 5/47; H01Q 5/378; H01Q 19/17; H01Q 19/18; H01Q 3/40;
(Continued)

(56) References Cited

U.S. PATENT DOCUMENTS 4,972,199 A * 11/1990 Raghavan ..... H01Q 19/17 343/756
5,325,101 A * 6/1994 Rudish ..... H01Q 3/22 342/372

(Continued)

FOREIGN PATENT DOCUMENTS

JP 03106103 * 5/1991
JP 3021480 * 3/2000
JP 3021480 B2 3/2000

OTHER PUBLICATIONS

Leclerc et al., "Ka-Band Multiple Feed per Beam Focal Array Using Interleaved Couplers", IEEE Trans. Microwave Theory and Techniques, vol. 62, No. 6, pp. 1322-1329, May 2014.

*Primary Examiner* — Awat M Salih
(74) *Attorney, Agent, or Firm* — Birch, Stewart, Kolasch & Birch, LLP.

(57) ABSTRACT

An antenna device includes a beamforming circuit (3) that forms a radio wave in a first frequency band, including two polarized waves orthogonal to each other, and outputs the radio wave in the first frequency band, a beamforming circuit (6) that receives the radio wave in the first frequency band output from the beamforming circuit (3), and outputs a the radio wave in the first frequency band, and forms a radio wave in a second frequency band, including two polarized waves orthogonal to each other, and outputs the radio wave in the second frequency band, and primary radiators (7) that emit a beam in the first frequency band in response to the radio wave in the first frequency band output from the beamforming circuit (6), and emit a beam in the second frequency band in response to the radio wave in the second frequency band output from the beamforming circuit (6).

4 Claims, 13 Drawing Sheets

(51) Int. Cl.

| | |
|---|---|
| ***H01Q 5/378*** | (2015.01) |
| ***H01Q 13/02*** | (2006.01) |
| ***H01Q 15/14*** | (2006.01) |
| ***H01Q 19/18*** | (2006.01) |
| ***H01Q 5/47*** | (2015.01) |
| ***H01Q 19/17*** | (2006.01) |
| ***H01P 1/161*** | (2006.01) |
| ***H01Q 3/40*** | (2006.01) |
| ***H01Q 3/26*** | (2006.01) |
| ***H01P 1/213*** | (2006.01) |
| ***H01Q 25/00*** | (2006.01) |

(52) U.S. Cl.
CPC ..... *H01Q 3/2658* (2013.01); *H01Q 3/40* (2013.01); *H01Q 5/378* (2015.01); *H01Q 5/47* (2015.01); *H01Q 13/02* (2013.01); *H01Q 13/0258* (2013.01); *H01Q 15/14* (2013.01); *H01Q 19/17* (2013.01); *H01Q 19/18* (2013.01); *H01Q 21/064* (2013.01); *H01Q 25/007* (2013.01)

(58) Field of Classification Search
CPC .. H01Q 3/2658; H01Q 13/0258; H01Q 13/02; H01Q 25/007; H01Q 15/14; H01Q 21/064; H01P 1/161; H01P 1/2131
See application file for complete search history.

(56) References Cited

U.S. PATENT DOCUMENTS 5,410,320 A * 4/1995 Rudish ..... H01Q 3/22 342/368
5,430,453 A * 7/1995 Rudish ..... G01S 7/021 342/373
9,715,609 B1 * 7/2017 Fink ..... G06K 7/10366

* cited by examiner

ANTENNA DEVICE

TECHNICAL FIELD

This disclosure relates to antenna devices for forming multiple beams.

BACKGROUND ART

In recent years, research and development have been conducted for satellite communication technology that uses multiple beams.

One known technique for providing high-speed satellite communications is to cover a communicable service area with multiple spot beams.

A method for covering a service area with multiple spot beams uses an antenna including an antenna system with multiple primary radiators and one reflective mirror.

The multiple primary radiators included in the antenna system of such antenna each emit a single beam.

To increase the gain in service areas, it is necessary to arrange beams emitted from the multiple primary radiators to a corresponding service area densely. To this end, an antenna including three or four antenna systems exists.

However, because the number of reflective mirrors that can be mounted on a satellite has a limit, it is desirable to reduce the number of reflective mirrors.

To reduce the number of reflective mirrors, Non-Patent Literature 1 below discloses an antenna device that includes a beamforming circuit for forming beams and uses multiple primary radiators in common.

CITATION LIST

Non-Patent Literatures

Non-Patent Literature 1: C. Leclerc et. al, "Ka-Band Multiple Feed per Beam Focal Array Using Interleaved Couplers", IEEE Trans. Microwave Theory and Techniques, vol. 62, no. 6, pp. 1322-1329, May 2014

SUMMARY OF INVENTION

Technical Problem

The above configuration of a conventional antenna device enables a reduction in the number of reflective mirrors, but involves a problem in that beams in multiple frequency bands cannot be emitted.

Embodiments of this disclosure have been made to overcome the foregoing problem, and an object of the embodiments is to provide an antenna device capable of emitting beams in multiple frequency bands.

Solution to Problem

An antenna device according to this disclosure includes a first beamforming circuit for forming a radio wave including two polarized waves orthogonal to each other in a first frequency band to output the radio wave in the first frequency band; a second beamforming circuit for receiving the radio wave in the first frequency band output from the first beamforming circuit to output the radio wave in the first frequency band, and for forming a radio wave including two polarized waves orthogonal to each other in a second frequency band to output the radio wave in the second frequency band; and a plurality of primary radiators for emitting a beam in the first frequency band in response to the radio wave in the first frequency band output from the second beamforming circuit, and emitting a beam in the second frequency band in response to the radio wave in the second frequency band output from the second beamforming circuit.

Advantageous Effects of Invention

According to an aspect of the embodiments, an antenna device is configured to include a first beamforming circuit for forming a radio wave including two polarized waves orthogonal to each other in a first frequency band to output the radio wave in the first frequency band; a second beamforming circuit for receiving the radio wave in the first frequency band output from the first beamforming circuit to output the radio wave in the first frequency band, and for forming a radio wave including two polarized waves orthogonal to each other in a second frequency band to output the radio wave in the second frequency band; and a plurality of primary radiators for emitting a beam in the first frequency band in response to the radio wave in the first frequency band output from the second beamforming circuit, and emitting a beam in the second frequency band in response to the radio wave in the second frequency band output from the second beamforming circuit. Thus, an advantage is offered in that beams in multiple frequency bands can be emitted.

DESCRIPTION OF EMBODIMENTS

To explain this disclosure in more detail, embodiments of this disclosure will be described below with reference to the accompanying drawings.

Embodiment 1

Figure 1:
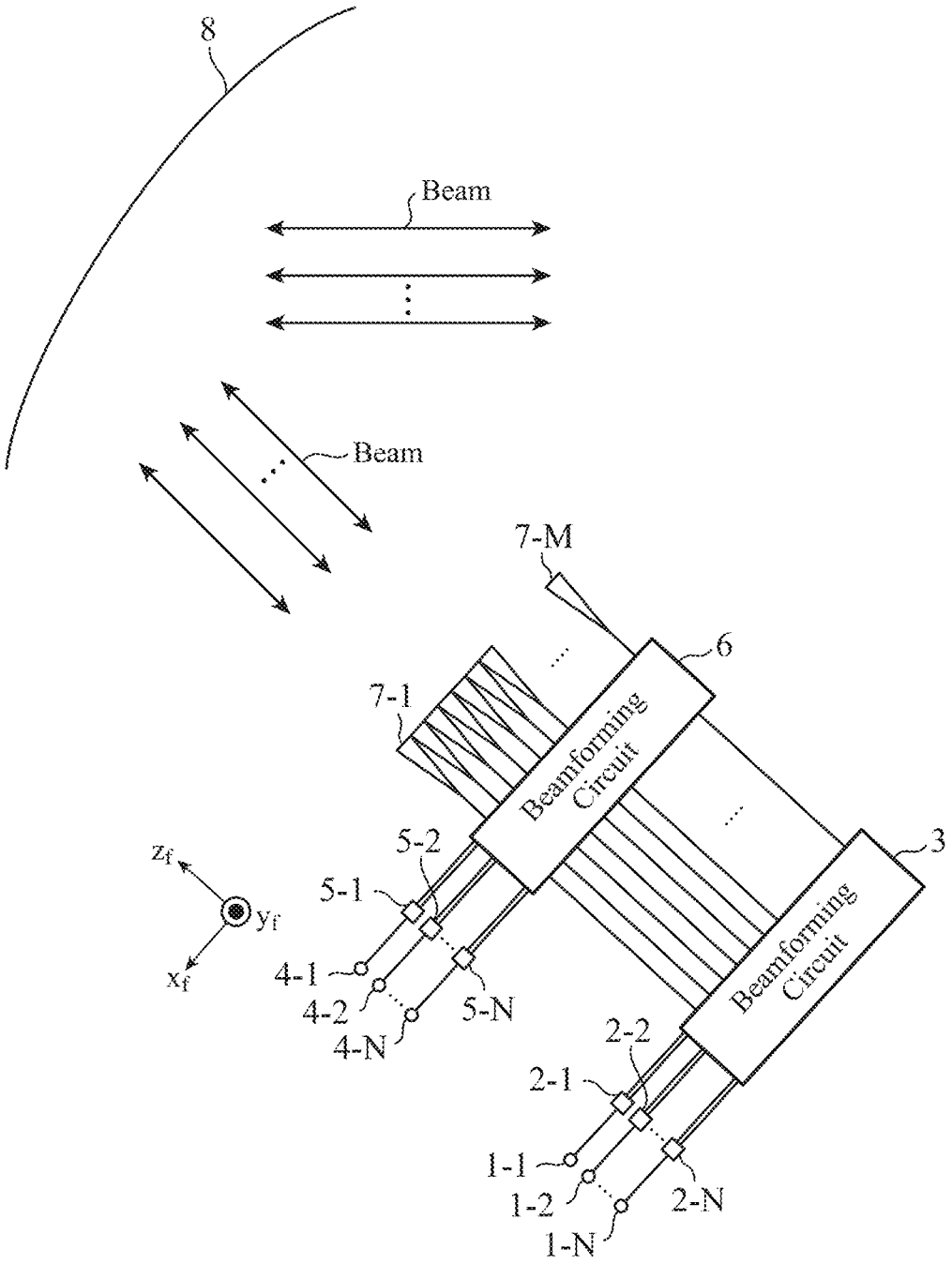
FIG. 1 is a configuration diagram illustrating an antenna device according to Embodiment 1 of this disclosure.

FIG. 1 is a configuration diagram illustrating an antenna device according to Embodiment 1 of this disclosure.

In FIG. 1, input-output ports 1-1 to 1-N each serve as a port for inputting or outputting a radio wave in a first frequency band.

In a case of use of the antenna device of FIG. 1 as a transmission antenna, T-shaped branches 2-1 to 2-N divide power of the radio waves respectively input from the input-output ports 1-1 to 1-N, and each output two radio waves generated by the power division to a beamforming circuit 3.

In a case of use of the antenna device of FIG. 1 as a receiving antenna, the T-shaped branches 2-1 to 2-N each combine two polarized waves output from the beamforming circuit 3, and output the resultant combined radio wave to the input-output ports 1-1 to 1-N respectively.

In a case of use as an element of a transmission antenna, the beamforming circuit 3 serves as a first beamforming circuit that forms a radio wave in the first frequency band including two polarized waves orthogonal to each other, from the two radio waves output from each of the T-shaped branches 2-1 to 2-N, and outputs the radio wave in the first frequency band to a beamforming circuit 6.

In a case of use as an element of a receiving antenna, the beamforming circuit 3 extracts two polarized waves included in a radio wave in the first frequency band output from the beamforming circuit 6, and outputs the two polarized waves to a corresponding one of the T-shaped branches 2-1 to 2-N.

In a case of use as elements of a transmission antenna, input-output ports 4-1 to 4-N each serve as a port for inputting and outputting a radio wave in a second frequency band different from the first frequency band.

In a case of use as elements of a transmission antenna, T-shaped branches 5-1 to 5-N divide power of the radio waves respectively input from the input-output ports 4-1 to 4-N, and each output two radio waves generated by the power division, to the beamforming circuit 6.

In a case of use as elements of a receiving antenna, the T-shaped branches 5-1 to 5-N each combine two polarized waves output from the beamforming circuit 6, and output the resultant combined radio wave to the input-output ports 4-1 to 4-N respectively.

In a case of use as an element of a transmission antenna, the beamforming circuit 6 serves as a second beamforming circuit that forms a radio wave in the second frequency band including two polarized waves orthogonal to each other, from the two radio waves output from each of the T-shaped branches 5-1 to 5-N, and outputs the radio wave in the second frequency band to predetermined ones of primary radiators 7-1 to 7-M.

In addition, the beamforming circuit 6 receives the radio wave in the first frequency band output from the beamforming circuit 3, and outputs the radio wave in the first frequency band to predetermined ones of the primary radiators 7-1 to 7-M.

In a case of use as an element of a receiving antenna, the beamforming circuit 6 outputs the radio wave in the first frequency band output from each of the primary radiators 7-1 to 7-M to the beamforming circuit 3.

In addition, the beamforming circuit 6 extracts the two polarized waves included in the radio wave in the second frequency band output from each of the primary radiators 7-1 to 7-M, and outputs the two polarized waves to a corresponding one of the T-shaped branches 5-1 to 5-N.

The primary radiators 7-1 to 7-M are disposed at or in the vicinity of the focal point of a primary reflective mirror 8.

In a case of use as elements of a transmission antenna, the predetermined ones of the primary radiators 7-1 to 7-M emit a beam in the first frequency band in response to the radio wave in the first frequency band output from the beamforming circuit 6, and emit a beam in the second frequency band in response to the radio wave in the second frequency band output from the beamforming circuit 6.

In a case of use as elements of a receiving antenna, the predetermined ones of the primary radiators 7-1 to 7-M receive a beam in the first frequency band reflected by the primary reflective mirror 8, and respectively output radio waves in the first frequency band to the beamforming circuit 6; and receive a beam in the second frequency band reflected by the primary reflective mirror 8, and respectively output radio waves in the second frequency band to the beamforming circuit 6.

When no distinction is made among the primary radiators 7-1 to 7-M, a designation of "primary radiator(s) 7" may be used.

In a case of use as an element of a transmission antenna, the primary reflective mirror 8 reflects the beam in the first frequency band and the beam in the second frequency band emitted from the predetermined ones of the primary radiators 7-1 to 7-M toward a service area.

In a case of use as an element of a receiving antenna, the primary reflective mirror 8 reflects a beam in the first frequency band and a beam in the second frequency band emitted from a communication device such as a mobile terminal in the service area toward the primary radiators 7-1 to 7-M.

Figure 2:
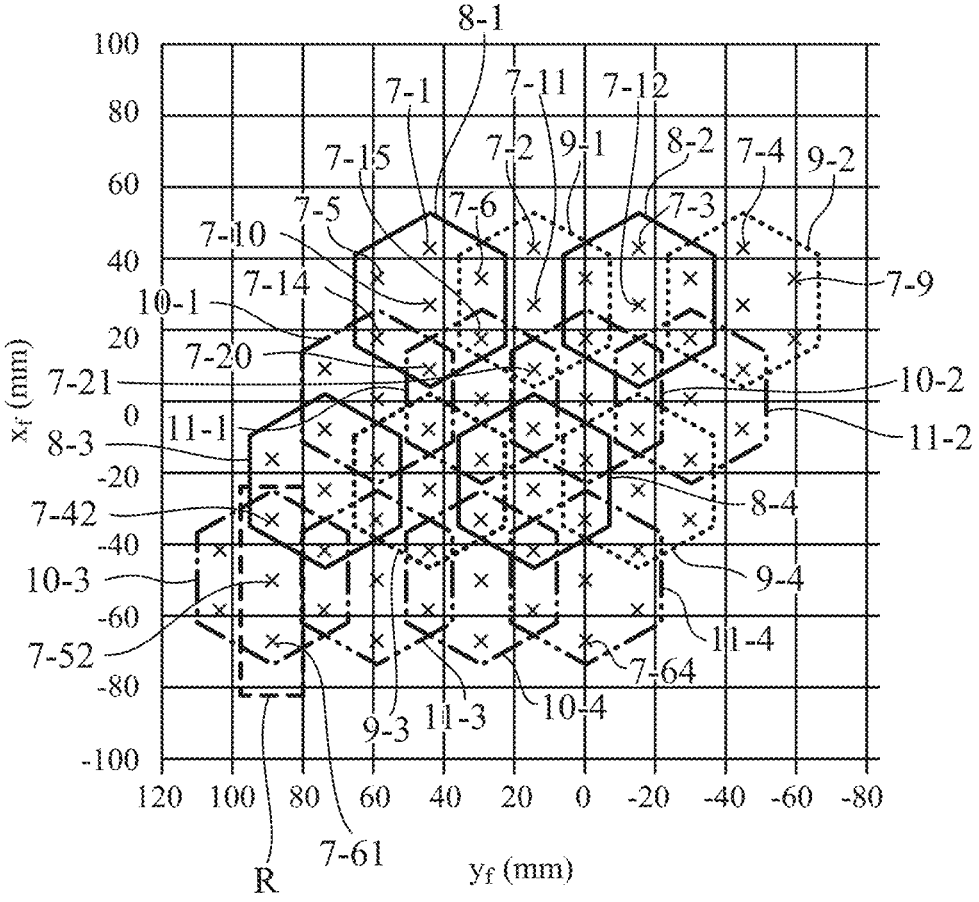
FIG. 2 is an illustrative diagram illustrating an arrangement of primary radiators 7-1 to 7-M as viewed from the front of the primary radiators 7-1 to 7-M.

FIG. 2 is an illustrative diagram illustrating an arrangement of the primary radiators 7-1 to 7-M as viewed from the front of the primary radiators 7-1 to 7-M.

That is, FIG. 2 illustrates an arrangement of the primary radiators 7-1 to 7-M as viewed from the $+z_f$ direction.

The example of FIG. 2 assumes that M=64, and thus 64 primary radiators 7-1 to 7-64 are provided.

In FIG. 2, the symbols, x, indicate the respective locations of the primary radiators 7-1 to 7-64.

FIG. 2 illustrates the 64 primary radiators 7-1 to 7-64 in sets of three primary radiators 7 such that the three primary radiators 7 in each set are disposed on the respective vertices of a regular triangle. The arrangement that places the three primary radiators 7 on the respective vertices of a regular triangle is an arrangement that provides a close-packed arrangement of multiple circular openings to allow multiple beams to be arranged close to each other.

For example, the primary radiator 7-1, the primary radiator 7-14, and the primary radiator 7-15 are disposed on the respective vertices of a regular triangle.

The primary radiator 7-6, the primary radiator 7-20, and the primary radiator 7-21 are also disposed on the vertices of a regular triangle.

Seven primary radiators 7 disposed adjacently to one another of the 64 primary radiators 7-1 to 7-64 are grouped into one group.

In the example of FIG. 2, seven primary radiators 7 located in a regular hexagon are grouped into one group.

FIG. 2 illustrates an example of emitting four different types of beams; and groups 8-1 to 8-4 are groups that each emit a first beam, and groups 9-1 to 9-4 are groups that each emit a second beam. Groups 10-1 to 10-4 are groups that each emit a third beam, and groups 11-1 to 11-4 are groups that each emit a fourth beam.

However, the groups 8-1 to 8-4, the groups 9-1 to 9-4, the groups 10-1 to 10-4, and the groups 11-1 to 11-4 do not necessarily need to emit four different types of beams, but a same type of beams may be emitted.

Figure 3:
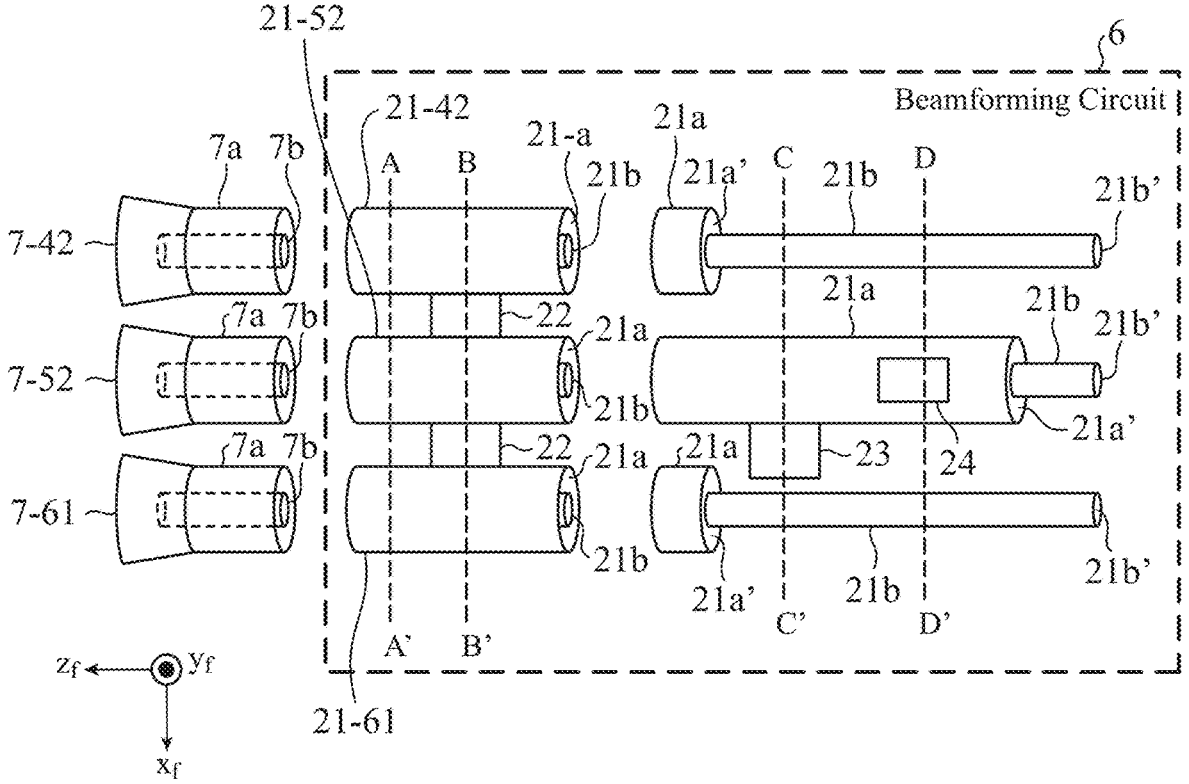
FIG. 3 is a configuration diagram illustrating a part of a beamforming circuit 6 of the antenna device according to Embodiment 1 of this disclosure.

FIG. 3 is a configuration diagram illustrating a part of the beamforming circuit 6 of the antenna device according to Embodiment 1 of this disclosure.

FIG. 3 illustrates a portion of the beamforming circuit 6 connected to three primary radiators 7-42, 7-52, and 7-61 included in the region indicated by R illustrated in FIG. 2.

In FIG. 3, each of the primary radiators 7-42, 7-52, and 7-61 is a horn antenna including a coaxial cylindrical waveguide.

The primary radiators 7-42, 7-52, and 7-61, each being a horn antenna, each include an outer waveguide 7*a* and an inner waveguide 7*b*.

FIG. 3 illustrates the primary radiators 7-42, 7-52, and 7-61 as being disconnected from the beamforming circuit 6, but in fact, the primary radiators 7-42, 7-52, and 7-61 are connected to the beamforming circuit 6.

The beamforming circuit 6 includes M coaxial waveguides 21-1 to 21-M.

When no distinction is made among the coaxial waveguide 21-1 to 21-M, a designation of "coaxial waveguide(s) 21" may be used.

FIG. 3 illustrates three coaxial waveguides 21-42, 21-52, and 21-61 respectively connected to the primary radiators 7-42, 7-52, and 7-61.

The coaxial waveguides 21-42, 21-52, and 21-61 each include an outer waveguide 21*a* and an inner waveguide 21*b*.

The outer waveguide 21*a* of each of the coaxial waveguides 21-42, 21-52, and 21-61 has one end connected to the outer waveguide 7*a* of the corresponding one of the primary radiators 7-42, 7-52, and 7-61, and has another end 21*a*' terminated.

In the example of FIG. 3, the other end 21*a*' of the outer waveguide 21*a* of each of the coaxial waveguides 21-42 and 21-61 is terminated at a location between line B-B' and line C-C'.

The another end 21*a*' of the outer waveguide 21*a* of the coaxial waveguide 21-52 is terminated at a position closer to the beamforming circuit 3 with respect to line D-D'.

The inner waveguide 21*b* of each of the coaxial waveguides 21-42, 21-52, and 21-61 has one end connected to the inner waveguide 7*b* of the corresponding one of the primary radiators 7-42, 7-52, and 7-61, and has another end 21*b*' connected to the beamforming circuit 3.

A rectangular waveguide 22 is a connecting waveguide that connects two adjacent coaxial waveguides 21.

In the example of FIG. 3, the rectangular waveguides 22 each connect two coaxial waveguides 21 along line B-B'.

A rectangular waveguide 23 is connected to the outer waveguide 21*a* of the coaxial waveguide 21-52 thus to serve as a power supply waveguide that provides a first polarized wave to the coaxial waveguide 21-52.

A rectangular waveguide 24 is connected to the outer waveguide 21*a* of the coaxial waveguide 21-52 such that the axial direction of the rectangular waveguide 24 is orthogonal to the axial direction of the rectangular waveguide 23 thus to serve as a power supply waveguide that provides a second polarized wave to the coaxial waveguide 21-52.

Note that the first polarized wave and the second polarized wave are polarized waves orthogonal to each other, and one example thereof is that the first polarized wave is a horizontally polarized wave, while the second polarized wave is a vertically polarized wave.

Figure 4:
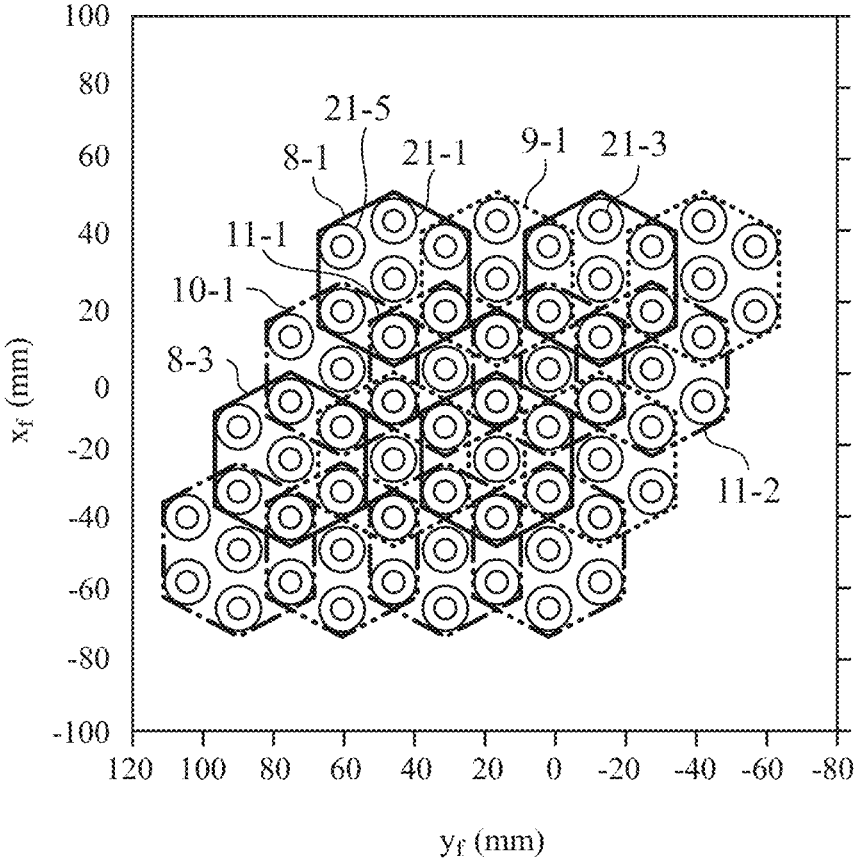
FIG. 4 is a cross-sectional view of the beamforming circuit 6 taken along line A-A' of FIG. 3.

FIG. 4 is a cross-sectional view of the beamforming circuit 6 taken along line A-A' of FIG. 3.

Figure 5:
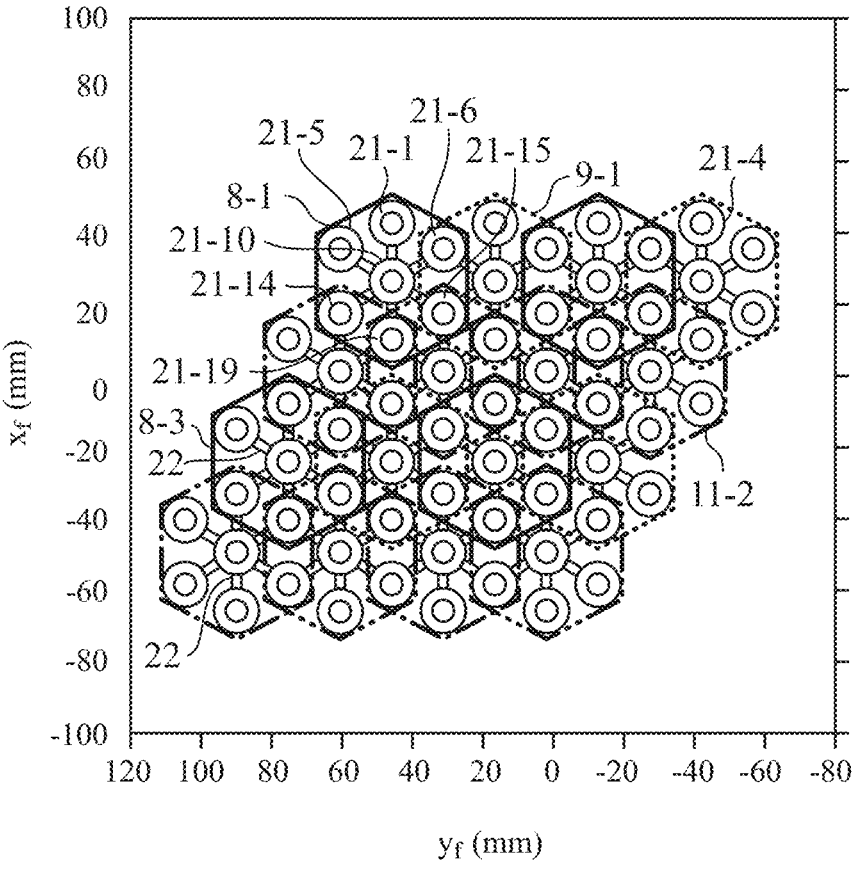
FIG. 5 is a cross-sectional view of the beamforming circuit 6 taken along line B-B' of FIG. 3.

FIG. 5 is a cross-sectional view of the beamforming circuit 6 taken along line B-B' of FIG. 3.

Figure 6:
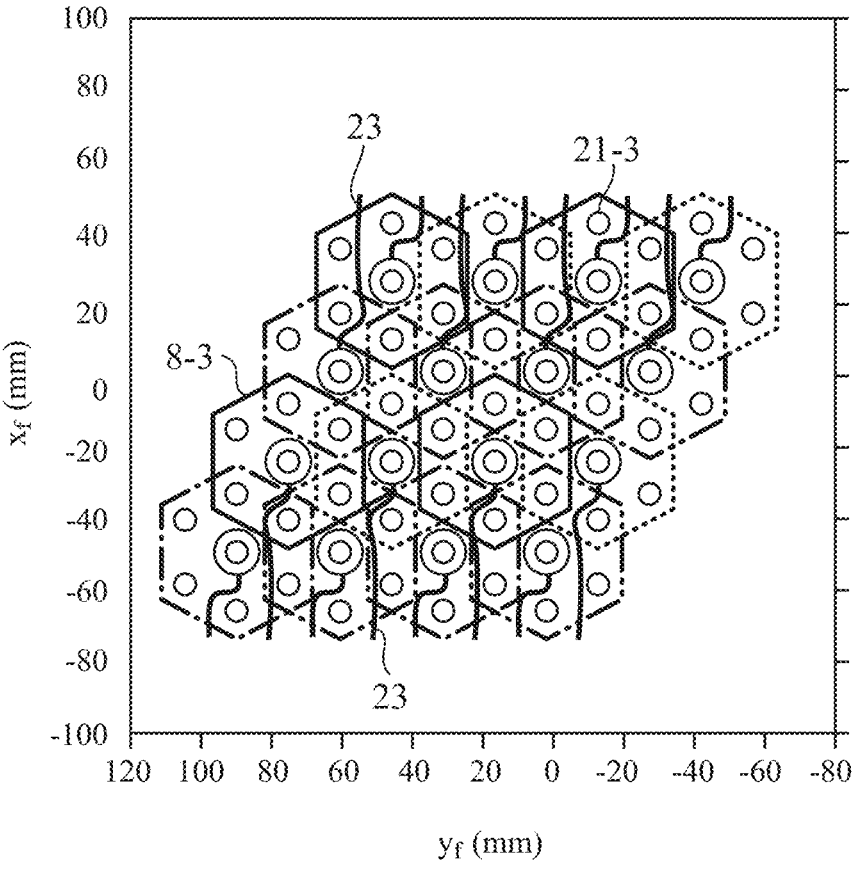
FIG. 6 is a cross-sectional view of the beamforming circuit 6 taken along line C-C' of FIG. 3.

FIG. 6 is a cross-sectional view of the beamforming circuit 6 taken along line C-C' of FIG. 3.

Figure 7:
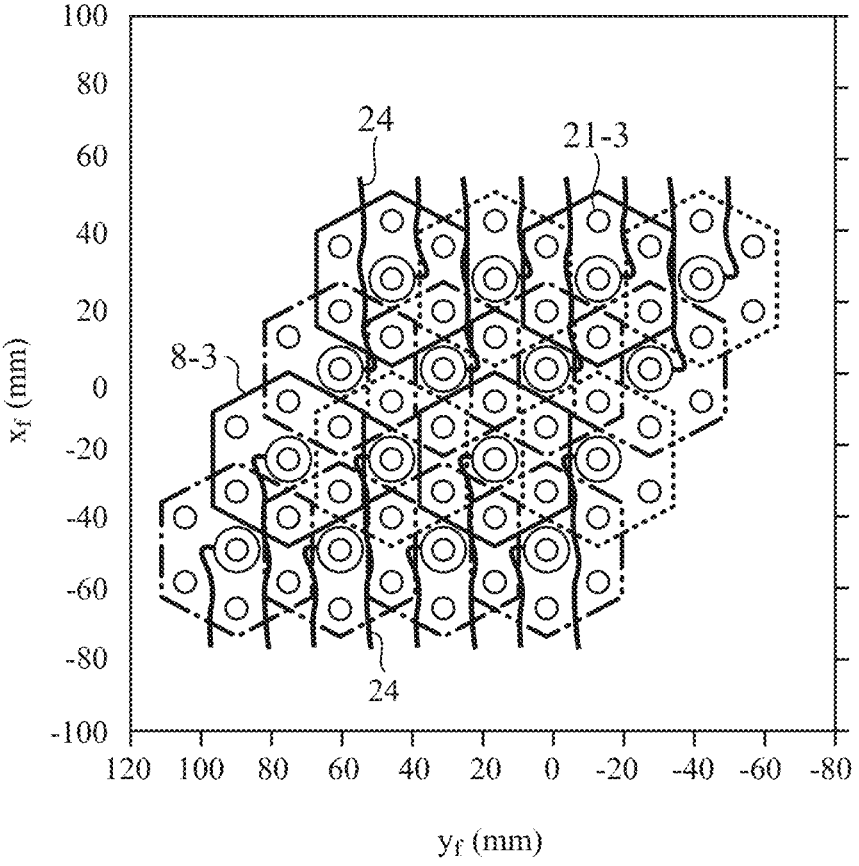
FIG. 7 is a cross-sectional view of the beamforming circuit 6 taken along line D-D' of FIG. 3.

FIG. 7 is a cross-sectional view of the beamforming circuit 6 taken along line D-D' of FIG. 3.

The seven primary radiators 7 included in each of the groups 8-1 to 8-4, 9-1 to 9-4, 10-1 to 10-4, and 11-1 to 11-4 include one primary radiator 7 located at the center, and six primary radiators 7 arranged radially thereabout.

The one primary radiator 7 located at the center in each of the groups is hereinafter referred to as central primary radiator 7, and the six primary radiators 7 located peripherally to the central primary radiator 7 are hereinafter referred to as peripheral primary radiators 7.

The seven primary radiators 7 in each of the groups are connected to corresponding ones of the coaxial waveguides 21 in the beamforming circuit 6.

A coaxial waveguide 21 connected to the central primary radiator 7 is hereinafter referred to as central coaxial waveguide 21, and coaxial waveguides 21 respectively connected to the peripheral primary radiators are hereinafter each referred to as peripheral coaxial waveguide 21.

As illustrated in FIG. 5, the central coaxial waveguide 21 is connected to six peripheral coaxial waveguides 21 on the x-y plane by six rectangular waveguides 22 radially extending from that central coaxial waveguide 21.

In each of the groups 8-1 to 8-4, 9-1 to 9-4, 10-1 to 10-4, and 11-1 to 11-4, the rectangular waveguide 23 is connected to the central coaxial waveguide 21 along a direction parallel to the x-axis of FIG. 6. In addition, the rectangular waveguide 23 is arranged not to interfere with the peripheral coaxial waveguides 21.

In each of the groups 8-1 to 8-4, 9-1 to 9-4, 10-1 to 10-4, and 11-1 to 11-4, the rectangular waveguide 24 is connected to the central coaxial waveguide 21 along a direction parallel to the y-axis of FIG. 7. In addition, the rectangular waveguide 24 is arranged not to interfere with the peripheral coaxial waveguides 21.

Figure 8:
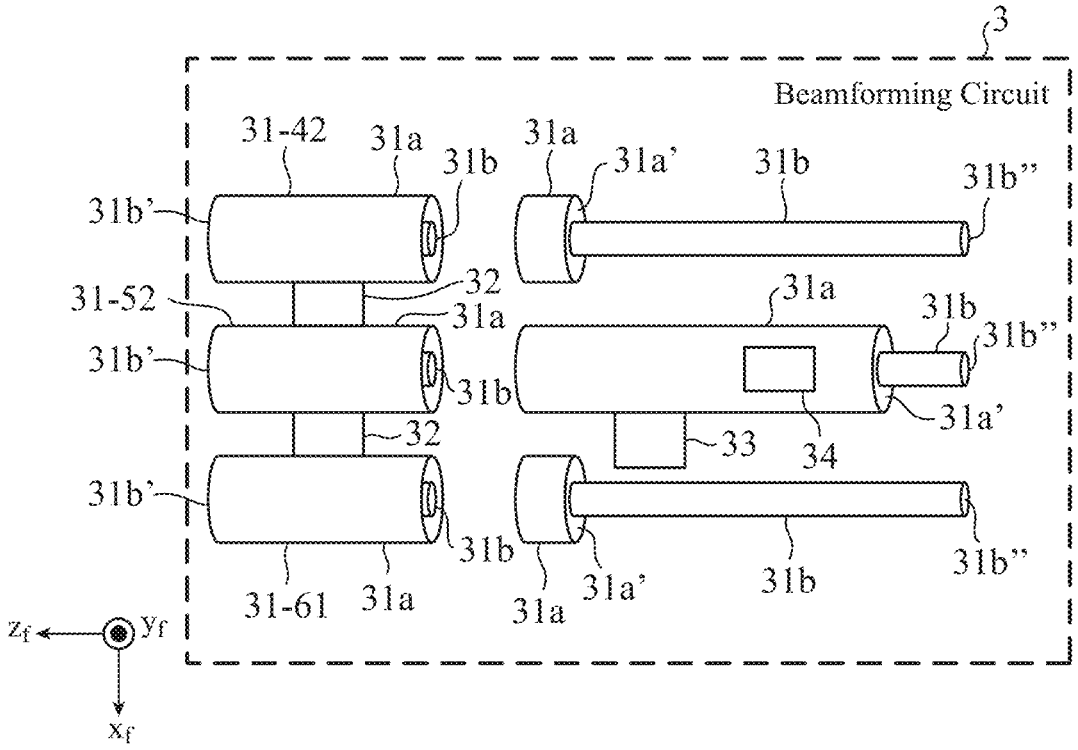
FIG. 8 is a configuration diagram illustrating a part of a beamforming circuit 3 of the antenna device according to Embodiment 1 of this disclosure.

FIG. 8 is a configuration diagram illustrating a part of the beamforming circuit 3 of the antenna device according to Embodiment 1 of this invention.

FIG. 8 illustrates a portion of the beamforming circuit 3 connected to three coaxial waveguides 21-42, 21-52, and 21-61 illustrated in FIG. 3.

In FIG. 8, the beamforming circuit 3 includes M coaxial waveguides 31-1 to 31-M.

When no distinction is made between the coaxial waveguides 31-1 to 31-M, a designation of "coaxial waveguide(s) 31" may be used.

FIG. 8 illustrates three coaxial waveguides 31-42, 31-52, and 31-61 respectively connected to the coaxial waveguides 21-42, 21-52, and 21-61 of the beamforming circuit 6.

The coaxial waveguides 31-42, 31-52, and 31-61 each include an outer waveguide 31*a* and an inner waveguide 31*b*.

The outer waveguide 31*a* of each of the coaxial waveguides 31-42, 31-52, and 31-61 has one end 31*a*' terminated.

The inner waveguide 31*b* of each of the coaxial waveguides 31-42, 31-52, and 31-61 has one end 31*b*' connected to the other end 21*b*' of the inner waveguide 21*b* of the corresponding one of the coaxial waveguides 21-42, 21-52, and 21-61.

The inner waveguide 31*b* of each of the coaxial waveguides 31-42, 31-52, and 31-61 has another end 31*b*" terminated.

A rectangular waveguide 32 is a connecting waveguide that connects two coaxial waveguides 31.

A rectangular waveguide 33 is connected to the outer waveguide 31*a* of the coaxial waveguide 31-52 thus to serve as a power supply waveguide that provides a third polarized wave to the coaxial waveguide 31-52.

A rectangular waveguide 34 is connected to the outer waveguide 31*a* of the coaxial waveguide 31-52 such that the axial direction of the rectangular waveguide 34 is orthogonal to the axial direction of the rectangular waveguide 33 thus to serve as a power supply waveguide that provides a fourth polarized wave to the coaxial waveguide 31-52.

Note that the third polarized wave and the fourth polarized wave are polarized waves orthogonal to each other, and one example thereof is that the third polarized wave is a horizontally polarized wave, while the fourth polarized wave is a vertically polarized wave.

Next, operations are described.

Operations by the antenna device of FIG. 1 of sending a beam in the first frequency band and a beam in the second frequency band will first be described.

A radio wave in the first frequency band is input from each of the input-output ports 1-1 to 1-N.

Upon input of the radio waves in the first frequency band respectively from the input-output ports 1-1 to 1-N, the T-shaped branches 2-1 to 2-N respectively divide power of the radio waves input, and each output two radio waves generated by the power division, to the beamforming circuit 3.

Embodiment 1 assumes that the antenna device of FIG. 1 emits N beams.

Thus, the T-shaped branch 2-*n* (n=1, 2, . . . , N) outputs the two radio waves to the central coaxial waveguide 31 of the coaxial waveguides 31 respectively connected to the seven primary radiators 7, via the respective coaxial waveguides 21, included in the group that emits an n-th (n=1, 2, . . . , N) beam among the M coaxial waveguides 31-1 to 31-M of the beamforming circuit 3.

FIG. 2 illustrates an example of a case of M=64 and N=4, and therefore 64 primary radiators 7-1 to 7-64 are grouped into the groups 8-1 to 8-4, 9-1 to 9-4, 10-1 to 10-4, and 11-1 to 11-4.

Thus, for example, as far as the group 8-1 is concerned, the T-shaped branch 2-1 outputs two radio waves associated with the radio wave input from the input-output port 1-1, to the coaxial waveguide 31-10 connected to the primary radiator 7-10 via the coaxial waveguide 21-10.

Moreover, as far as the group 9-1 is concerned, the T-shaped branch 2-2 outputs two radio waves associated with the radio wave input from the input-output port 1-2, to the coaxial waveguide 31-11 connected to the primary radiator 7-11 via the coaxial waveguide 21-11.

Upon reception of the two radio waves from each of the T-shaped branches 2-1 to 2-N, the beamforming circuit 3 forms, from the two radio waves, a radio wave in the first frequency band including two polarized waves orthogonal to each other, and outputs N radio waves in the first frequency band to the beamforming circuit 6.

An operation of the beamforming circuit 3 will be described in detail below.

The rectangular waveguide 33 and the rectangular waveguide 34 are connected to the central coaxial waveguide 31 of the coaxial waveguides 31 respectively connected, via the respective coaxial waveguides 21, to the seven primary radiators 7 in the group that emits the n-th beam.

Among the two radio waves output from the T-shaped branch 2-*n*, one radio wave is input from the rectangular waveguide 33, and the other radio wave is input from the rectangular waveguide 34.

Thus, the radio wave input from the rectangular waveguide 33 is propagated through the central coaxial waveguide 31 as the third polarized wave.

The radio wave input from the rectangular waveguide is propagated through the central coaxial waveguide 31 as the fourth polarized wave.

The central coaxial waveguide 31 is connected to the six peripheral coaxial waveguides 31 through the rectangular waveguides 32. This configuration causes the six peripheral coaxial waveguides 31 to each receive the third polarized wave and the fourth polarized wave propagated through the central coaxial waveguide 31, and thus to each propagate the third polarized wave and the fourth polarized wave.

This in turn causes the seven coaxial waveguides 31 to output the third polarized wave and the fourth polarized wave to the coaxial waveguides 21 respectively connected to those seven coaxial waveguides 31, among the M coaxial waveguides 21-1 to 21-M of the beamforming circuit 6.

A radio wave in the second frequency band is input from each of the input-output ports 4-1 to 4-N.

Upon input of the radio waves in the second frequency band respectively from the input-output ports 4-1 to 4-N, the T-shaped branches 5-1 to 5-N respectively divide power of the radio waves input, and each output two radio waves generated by the power division, to the beamforming circuit 6.

Embodiment 1 assumes that the antenna device of FIG. 1 emits N beams.

Thus, the T-shaped branch 5-*n* (n=1, 2, . . . , N) outputs the two radio waves to the central coaxial waveguide 21 of the coaxial waveguides 21 respectively connected to the seven primary radiators 7 included in the group that emits the n-th beam, among the M coaxial waveguides 21-1 to 21-M of the beamforming circuit 6.

For example, as far as the group 8-1 is concerned, the T-shaped branch 5-1 outputs two radio waves associated with the radio wave input from the input-output port 4-1, to the coaxial waveguide 21-10 connected to the primary radiator 7-10.

In addition, as far as the group 9-1 is concerned, the T-shaped branch 5-2 outputs two radio waves associated with the radio wave input from the input-output port 4-2, to the coaxial waveguide 21-11 connected to the primary radiator 7-11.

Upon reception of the two radio waves from each of the T-shaped branches 5-1 to 5-N, the beamforming circuit 6 forms, from the two radio waves, a radio wave in the second frequency band including two polarized waves orthogonal to each other, and outputs N radio waves in the second frequency band to the primary radiators 7-1 to 7-M.

In addition, upon reception of the N radio waves in the first frequency band from the beamforming circuit 3, the beamforming circuit 6 outputs N radio waves in the first frequency band to the primary radiators 7-1 to 7-M.

Operations of the beamforming circuit 6 will be described in detail below.

The rectangular waveguide 23 and the rectangular waveguide 24 are connected to the central coaxial waveguide 21 of the coaxial waveguides 21 respectively connected to the seven primary radiators 7 included in the group that emits the n-th beam.

Among the two radio waves output from the T-shaped branch 5-*n*, one radio wave is input from the rectangular waveguide 23, and the other radio wave is input from the rectangular waveguide 24.

Thus, the radio wave input from the rectangular waveguide 23 is propagated through the central coaxial waveguide 21 as the first polarized wave.

The radio wave input from the rectangular waveguide is propagated through the central coaxial waveguide 21 as the second polarized wave.

In addition, the third polarized wave and the fourth polarized wave output from the beamforming circuit 3 are propagated through the central coaxial waveguide 21.

The central coaxial waveguide 21 is connected to the six peripheral coaxial waveguides 21 through the rectangular waveguides 22. This configuration causes the six peripheral coaxial waveguides 21 to each receive the first to fourth polarized waves propagated through the central coaxial waveguide 21, and thus to each propagate the first to fourth polarized waves.

This in turn causes the seven coaxial waveguides 21 to output the first to fourth polarized waves to the seven primary radiators 7 included in the group that emits the n-th beam, among the M primary radiators 7-1 to 7-M.

The seven primary radiators 7 included in the group that emits the n-th beam emit a radio wave including the first polarized wave and the second polarized wave, of the first to fourth polarized waves output from the beamforming circuit 6, toward the primary reflective mirror 8 as the beam in the first frequency band.

The seven primary radiators 7 included in the group that emits the n-th beam also emit a radio wave including the third polarized wave and the fourth polarized wave toward the primary reflective mirror 8 as the beam in the second frequency band.

FIG. 2 illustrates an example of a case of N=4, and therefore the primary radiators 7 included in each of the groups 8-1 to 8-4 emit a first beam, and the primary radiators 7 included in each of the groups 9-1 to 9-4 emit a second beam.

The primary radiators 7 included in each of the groups 10-1 to 10-4 emit a third beam, and the primary radiators 7 included each of in the groups 11-1 to 11-4 emit a fourth beam.

The primary reflective mirror 8 reflects the beam in the first frequency band emitted from the primary radiators 7 included in the group that emits the n-th (n=1, 2, . . . , N) beam toward a service area, and also reflects the beam in the second frequency band emitted from the primary radiators 7 toward the service area.

Figure 9:
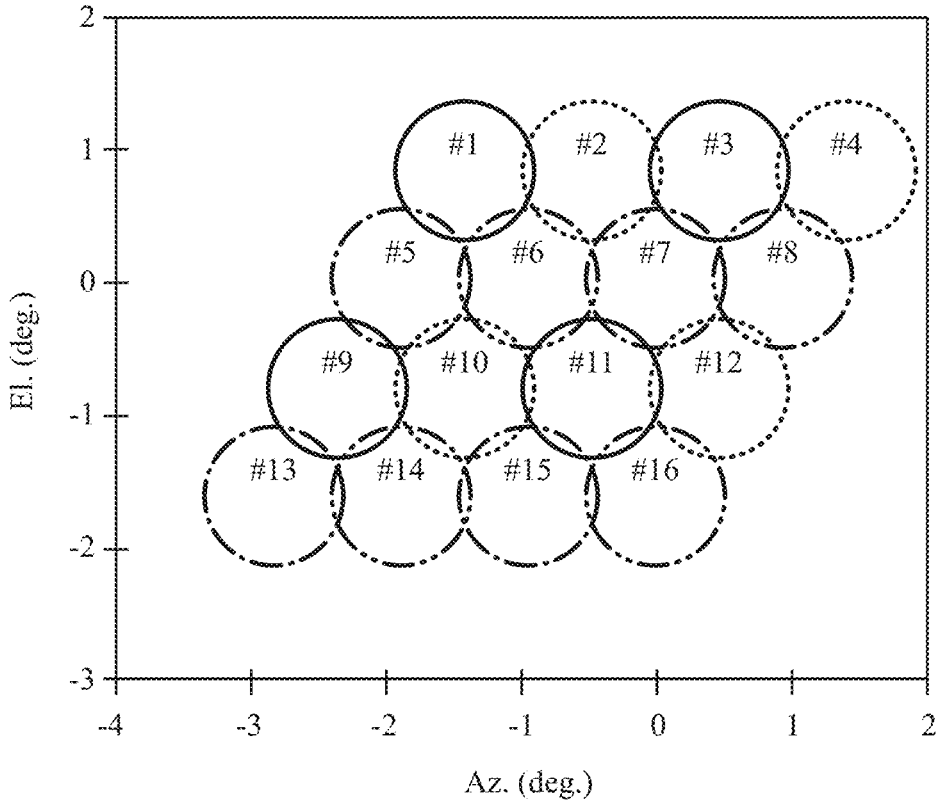
FIG. 9 is an illustrative diagram illustrating beam radiation directions toward a service area in an arrangement of the primary radiators 7-1 to 7-M as illustrated in FIG. 2.

FIG. 9 is an illustrative diagram illustrating beam radiation directions toward a service area in an arrangement of the primary radiators 7-1 to 7-M as illustrated in FIG. 2.

In FIG. 9, the horizontal axis represents an angle in the horizontal plane, and the vertical axis represents an angle in the vertical plane.

FIG. 9 illustrates an example of a case of N=16. The antenna device is emitting 16 beams, and the 16 beams partly overlap one another.

The area #1 represents the radiation direction of the beam emitted from the seven coaxial waveguides included in the group 8-1; the area #2 represents the radiation direction of the beam emitted from the seven coaxial waveguides included in the group 9-1; the area #3 represents the radiation direction of the beam emitted from the seven coaxial waveguides included in the group 8-2; and the area #4 represents the radiation direction of the beam emitted from the seven coaxial waveguides included in the group 9-2.

The area #5 represents the radiation direction of the beam emitted from the seven coaxial waveguides included in the group 10-1; the area #6 represents the radiation direction of the beam emitted from the seven coaxial waveguides included in the group 11-1; the area #7 represents the radiation direction of the beam emitted from the seven coaxial waveguides included in the group 10-2; and the area #8 represents the radiation direction of the beam emitted from the seven coaxial waveguides included in the group 11-2.

The area #9 represents the radiation direction of the beam emitted from the seven coaxial waveguides included in the group 8-3; the area #10 represents the radiation direction of the beam emitted from the seven coaxial waveguides included in the group 9-3; the area #11 represents the radiation direction of the beam emitted from the seven coaxial waveguides included in the group 8-4; and the area #12 represents the radiation direction of the beam emitted from the seven coaxial waveguides included in the group 9-4.

The area #13 represents the radiation direction of the beam emitted from the seven coaxial waveguides included in the group 10-3; the area #14 represents the radiation direction of the beam emitted from the seven coaxial waveguides included in the group 11-3; the area #15 represents the radiation direction of the beam emitted from the seven coaxial waveguides included in the group 10-4; and the area #16 represents the radiation direction of the beam emitted from the seven coaxial waveguides included in the group 11-4.

Figure 10:
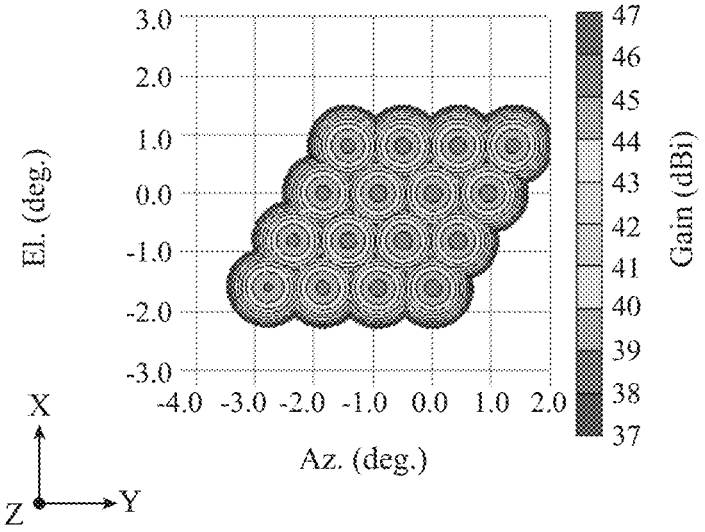
FIG. 10 is an illustrative diagram illustrating a radiation pattern when only beams in a first frequency band are emitted from the antenna device.

FIG. 10 is an illustrative diagram illustrating a radiation pattern when only beams in the first frequency band are emitted from the antenna device.

Figure 11:
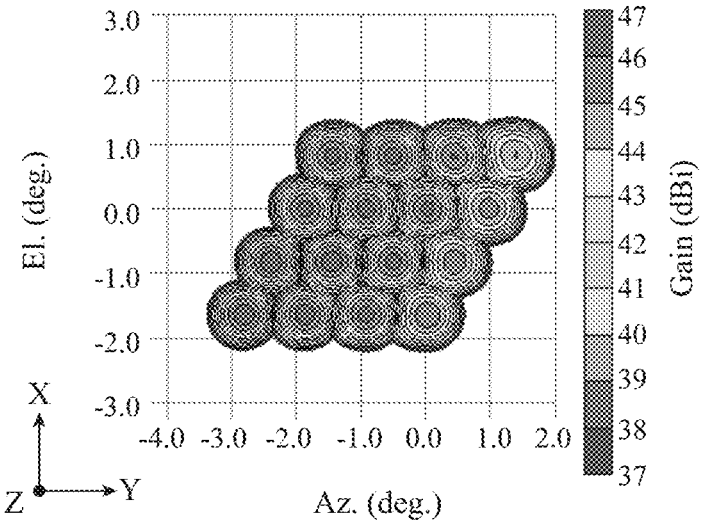
FIG. 11 is an illustrative diagram illustrating a radiation pattern when only beams in a second frequency band are emitted from the antenna device.

FIG. 11 is an illustrative diagram illustrating a radiation pattern when only beams in the second frequency band are emitted from the antenna device.

In FIGS. 10 and 11, the horizontal axis represents an angle in the horizontal plane, and the vertical axis represents an angle in the vertical plane.

FIGS. 10 and 11 each illustrate an example of a case of N=16. The antenna device is emitting 16 beams, and the service area is covered by the 16 beams.

In FIGS. 10 and 11, a gapless arrangement of the 16 beams covering the service area provides an increased gain in the service area.

Figure 12:
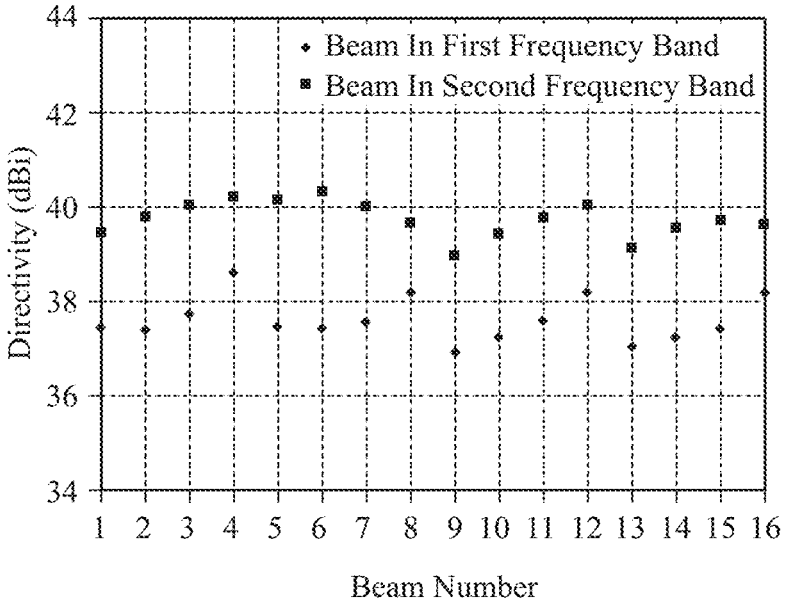
FIG. 12 is an illustrative diagram illustrating gains of respective beams when beams in the first frequency band and beams in the second frequency band are emitted from the antenna device.

FIG. 12 is an illustrative diagram illustrating gains of respective beams when beams in the first frequency band and beams in the second frequency band are emitted from the antenna device.

In FIG. 12, the horizontal axis represents a beam number. For example, the beam number "1" designates the beam having the radiation direction #1 as illustrated in FIG. 9; the beam number "2" designates the beam having the radiation direction #2 as illustrated in FIG. 9; and the beam number "16" designates the beam having the radiation direction #16 as illustrated in FIG. 9.

The vertical axis represents the gain of a beam; the symbols ◆ represent the beams in the first frequency band, and the symbols ■ represent the beams in the second frequency band.

FIG. 12 shows that generally uniform gains are achieved for the beams in both frequency bands.

Next, operations of the antenna device of FIG. 1 receiving a beam in the first frequency band and a beam in the second frequency band will be described.

The primary reflective mirror 8 reflects a beam in the first frequency band emitted from a communication device such as a mobile terminal located in a service area, toward the primary radiators 7-1 to 7-M.

The primary reflective mirror 8 also reflects a beam in the second frequency band emitted from the communication device such as a mobile terminal located in the service area, toward the primary radiators 7-1 to 7-M.

Upon reception of the beam in the first frequency band reflected by the primary reflective mirror 8, the primary radiators 7-1 to 7-M each output a radio wave that is the received beam in the first frequency band, to the beamforming circuit 6.

In addition, upon reception of the beam in the second frequency band reflected by the primary reflective mirror 8, the primary radiators 7-1 to 7-M each output a radio wave that is the received beam in the second frequency band, to the beamforming circuit 6.

Upon reception of the radio wave in the first frequency band from each of the primary radiators 7-1 to 7-M, the beamforming circuit 6 outputs a radio wave in the first frequency band to the beamforming circuit 3.

In addition, upon reception of the radio wave in the second frequency band from each of the primary radiators 7-1 to 7-M, the beamforming circuit 6 extracts the first polarized wave and the second polarized wave included in the radio wave in the second frequency band, and outputs the first polarized wave from the rectangular waveguide 23, and outputs the second polarized wave from the rectangular waveguide 24.

An operation of the beamforming circuit 6 will be described in detail below.

The seven primary radiators 7 included in the group that emits the n-th (n=1, 2, . . . , N) beam among the M primary radiators 7-1 to 7-M respectively output radio waves in the second frequency band to the coaxial waveguides 21 respectively connected to those primary radiators 7.

The central coaxial waveguide 21 of the coaxial waveguides 21, which are respectively connected to the seven primary radiators 7 included in the group that emits the n-th beam, is connected to the six peripheral coaxial waveguides 21 through the rectangular waveguides 22. Thus, a large portion of the radio wave in the second frequency band propagated through each of the coaxial waveguides 21 respectively connected to the seven primary radiators 7 included in the group that emits the n-th beam reaches the central coaxial waveguide 21.

Each central coaxial waveguide 21 is connected to a corresponding rectangular waveguide 23 and a rectangular waveguide 24.

This configuration causes the first polarized wave included in the radio wave in the second frequency band having reached the central coaxial waveguide 21 to be output from the rectangular waveguide 23, and the second polarized wave included in the radio wave in the second frequency band to be output from the rectangular waveguide 24.

Upon the output of the first polarized wave from the rectangular waveguide 23 and the output of the second polarized wave from the rectangular waveguide 24, the T-shaped branch 5-*n* combines the first polarized wave and the second polarized wave, and outputs the resultant combined radio wave to the input-output port 4-*n*.

The seven primary radiators 7 included in the group that emits the n-th (n=1, 2, . . . , N) beam among the M primary radiators 7-1 to 7-M respectively output radio waves in the first frequency band to the coaxial waveguides 21 respectively connected to those primary radiators 7.

The coaxial waveguides 21 respectively connected to the seven primary radiators 7 included in the group that emits the n-th beam respectively output radio waves in the first frequency band to the coaxial waveguides 31 respectively connected to those coaxial waveguides 21.

Upon reception of the radio wave in the first frequency band from the beamforming circuit 6, the beamforming circuit 3 extracts the third polarized wave and the fourth polarized wave included in the radio wave in the first frequency band, and outputs the third polarized wave from the rectangular waveguide 33, and outputs the fourth polarized wave from the rectangular waveguide 34.

An operation of the beamforming circuit 3 will be described in detail below.

The central coaxial waveguide 31 of the coaxial waveguides 31, which are respectively connected via the respective coaxial waveguides 21 to the seven primary radiators 7 included in the group that emits the n-th beam, is connected to the six peripheral coaxial waveguides 31 through the rectangular waveguides 32. Thus, a large portion of the radio wave in the first frequency band propagated through each of the coaxial waveguides 31 respectively connected, via the respective coaxial waveguides 21, to the seven primary radiators 7 included in the group that emits the n-th beam reaches the central coaxial waveguide 31.

Each central coaxial waveguide 31 is connected to a corresponding rectangular waveguide 33 and a rectangular waveguides 34.

This configuration causes the third polarized wave included in the radio wave in the first frequency band having reached the central coaxial waveguide 31 to be output from the rectangular waveguide 33, and the fourth polarized wave included in the radio wave in the second frequency band to be output from the rectangular waveguide 34.

Upon the output of the third polarized wave from the rectangular waveguide 33 and the output of the fourth polarized wave from the rectangular waveguide 34, the T-shaped branch 2-*n* combines the third polarized wave and the fourth polarized wave, and outputs the resultant combined radio wave to the input-output port 1-*n*.

As is obvious from the foregoing, according to Embodiment 1, the antenna device is configured to include the beamforming circuit 3 that forms a radio wave in a first frequency band, including two polarized waves orthogonal to each other, and outputs the radio wave in the first frequency band, the beamforming circuit 6 that receives the radio wave in the first frequency band output from the beamforming circuit 3, and outputs the radio wave in the first frequency band, and forms a radio wave in a second frequency band, including two polarized waves orthogonal to each other, and outputs the radio wave in the second frequency band, and the primary radiators 7 that emit a beam in the first frequency band in response to the radio wave in the first frequency band output from the beamforming circuit 6, and emit a beam in the second frequency band in response to the radio wave in the second frequency band output from the beamforming circuit 6. Thus, an advantage is offered in that beams in multiple frequency bands can be emitted.

Although Embodiment 1 has been described using an example in which the beamforming circuit 3 includes the rectangular waveguides 33 and 34, and the rectangular waveguides 33 and 34 input or output radio waves, no limitation thereto is intended.

For example, at the other end 31*b*" of the inner waveguide 31*b* of one or more of the coaxial waveguides 31, a wall portion of the inner waveguide 31*b* may input or output the third polarized wave, while a hollow portion of the inner waveguide 31*b* may input or output the fourth polarized wave.

Embodiment 2

In Embodiment 1, an antenna device including the primary reflective mirror 8 that reflects a beam has been described. In Embodiment 2, an antenna device including, in addition to the primary reflective mirror 8, a secondary reflective mirror 40 that reflects a beam will be described.

Figure 13:
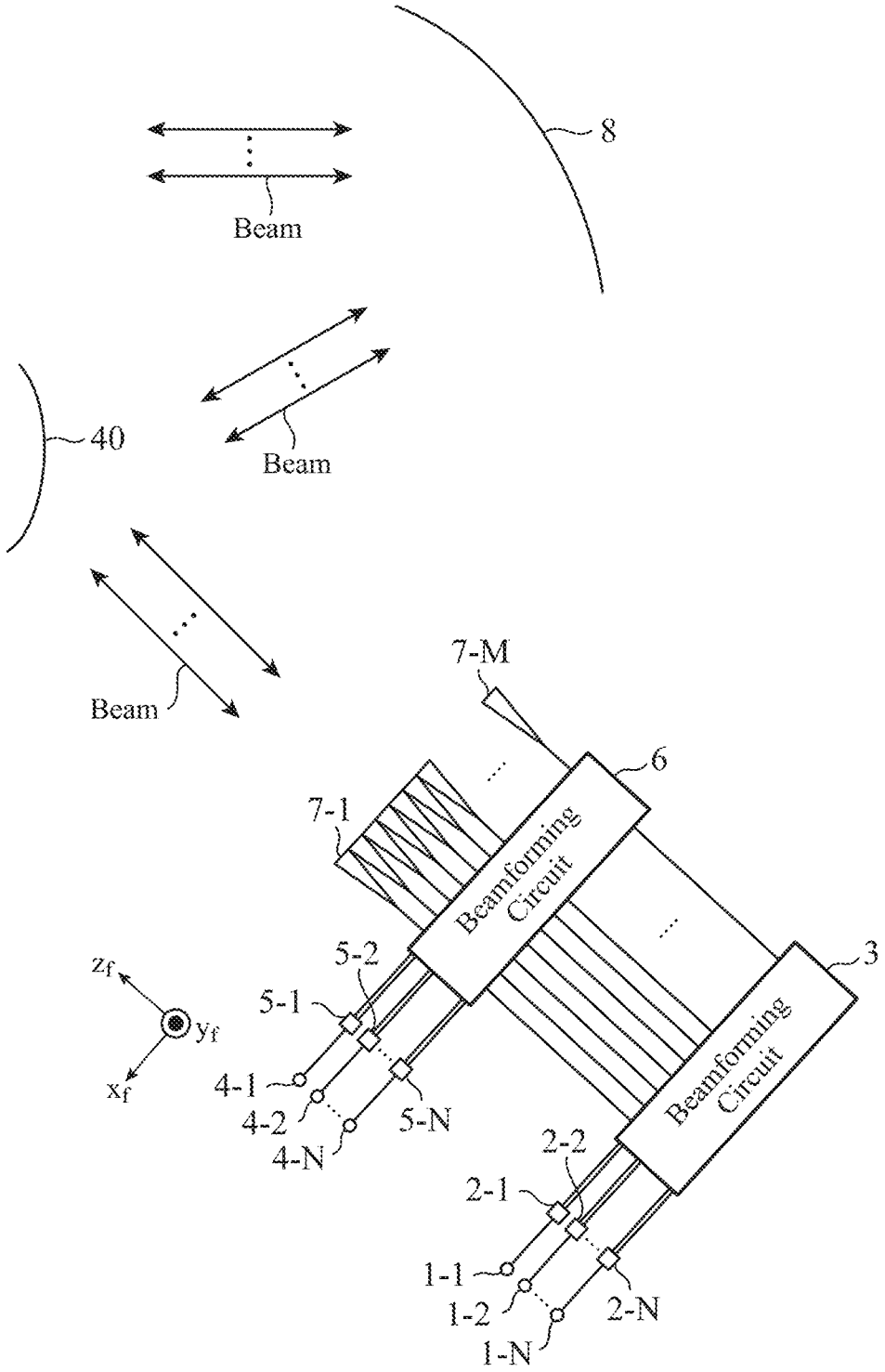
FIG. 13 is a configuration diagram illustrating an antenna device according to Embodiment 2 of this disclosure.

FIG. 13 is a configuration diagram illustrating an antenna device according to Embodiment 2 of this disclosure. In FIG. 13, the same reference characters as those used in FIG. 1 designate like or corresponding parts, and the description thereof will be omitted.

The secondary reflective mirror 40 reflects beams emitted from the primary radiators 7-1 to 7-M toward the primary reflective mirror 8, and conversely, reflects beams reflected by the primary reflective mirror 8 toward the primary radiators 7-1 to 7-M.

FIG. 13 illustrates an example of the secondary reflective mirror 40 as being a reflective mirror of a Cassegrain configuration having a specular surface of a hyperboloid of revolution.

However, the secondary reflective mirror 40 is not limited to a reflective mirror of a Cassegrain configuration, but may also be a reflective mirror of a Gregorian configuration having a specular surface of an ellipsoid of revolution. Alternatively, the secondary reflective mirror 40 may also be a reflective mirror having a flat specular surface.

Furthermore, the secondary reflective mirror 40 may include multiple reflective mirrors.

Similarly to the case of the above Embodiment 1, use of the secondary reflective mirror 40 in addition to the primary reflective mirror 8 offers an advantage in capability of emitting beams in multiple frequency bands.

Moreover, use of the secondary reflective mirror 40 offers an advantage in capability of providing a beam coverage over a service area also in a location that cannot be covered by the beams by only using the primary reflective mirror 8.

Note that any combinations of the embodiments, modifications to any elements included in the embodiments, and/or omissions of any elements included in the embodiments may be made within the scope of the invention.

INDUSTRIAL APPLICABILITY

Embodiments of this disclosure are suitable for antenna devices for forming multiple beams.

REFERENCE SIGNS LIST

1-1 to 1-N input-output port; 2-1 to 2-N T-shaped branch; 3 beamforming circuit (first beamforming circuit); 4-1 to 4-N input-output port; 5-1 to 5-N T-shaped branch; 6 beamforming circuit (second beamforming circuit); 7-1 to 7-M primary radiator; 8 primary reflective mirror; 8-1 to 8-4 group; 9-1 to 9-4 group; 10-1 to 10-4 group; 11-1 to 11-4 group; 21-1 to 21-M coaxial waveguide; 21*a* outer waveguide; 21*a*' another end of outer waveguide 21*a*; 21*b* inner waveguide; 21*b*' another end of inner waveguide 21*b*; 22 rectangular waveguide (connecting waveguide); 23 rectangular waveguide (power supply waveguide); 24 rectangular waveguide (power supply waveguide); 31-1 to 31-M coaxial waveguide; 31*a* outer waveguide; 31*a*' one end of outer waveguide 31*a*; 31*b* inner waveguide; 31*b*' one end of inner waveguide 31*b*; 31*b*" another end of inner waveguide 31*b*; 32 rectangular waveguide; 33 rectangular waveguide; 34 rectangular waveguide; 40 secondary reflective mirror.

The invention claimed is:

1. An antenna device comprising:

a first beamforming circuit for forming a radio wave including two polarized waves orthogonal to each other in a first frequency band to output the radio wave in the first frequency band;

a second beamforming circuit for receiving the radio wave in the first frequency band output from the first beamforming circuit to output the radio wave in the first frequency band, and for forming a radio wave including two polarized waves orthogonal to each other in a second frequency band to output the radio wave in the second frequency band; and a plurality of primary radiators for emitting a beam in the first frequency band in response to the radio wave in the first frequency band output from the second beamforming circuit, and emitting a beam in the second frequency band in response to the radio wave in the second frequency band output from the second beamforming circuit, wherein each of the plurality of primary radiators comprises a horn antenna including a coaxial cylindrical waveguide, the plurality of horn antennas are connected to the second beamforming circuit, and the second beamforming circuit is connected to the first beamforming circuit, the second beamforming circuit includes a plurality of coaxial waveguides connected to a corresponding one of the plurality of horn antennas, a plurality of connecting waveguides connecting among the plurality of coaxial waveguides, and power supply waveguides connected to one coaxial waveguide of the plurality of coaxial waveguides, the power supply waveguides being for providing two polarized waves orthogonal to each other to the one coaxial waveguide, the plurality of coaxial waveguides each include an inner waveguide having one end connected to an inner waveguide of a corresponding one of the plurality of horn antennas, and each inner waveguide of the plurality of coaxial waveguides includes another end connected to the first beamforming circuit, and the plurality of coaxial waveguides each include an outer waveguide having one end connected to an outer waveguide of a corresponding one of the plurality of horn antennas, and each outer waveguide of the plurality of coaxial waveguides includes another end terminated.

2. The antenna device according to claim 1, comprising:

a primary reflective mirror for reflecting a beam emitted from the plurality of primary radiators.

3. The antenna device according to claim 1, comprising:

a secondary reflective mirror for reflecting a beam emitted from the plurality of primary radiators; and a primary reflective mirror for reflecting the beam reflected by the secondary reflective mirror.

4. The antenna device according to claim 1, wherein the plurality of primary radiators receive a beam in the first frequency band, and each output a radio wave in the first frequency band to the second beamforming circuit, and receive a beam in the second frequency band, and each output a radio wave in the second frequency band to the second beamforming circuit, the second beamforming circuit outputs the radio wave in the first frequency band output from each of the plurality of primary radiators to the first beamforming circuit, and outputs two polarized waves included in the radio wave in the second frequency band output from each of the plurality of primary radiators, and the first beamforming circuit outputs two polarized waves included in each of the radio waves in the first frequency band output from the second beamforming circuit.

* * * * *